United States Patent [19]

Bullard

[11] 4,063,511

[45] Dec. 20, 1977

[54] SPINNING SHOT GUN PROJECTILE

[76] Inventor: James M. Bullard, 2622 NW. 25th Place, Portland, Oreg. 97210

[21] Appl. No.: 707,363

[22] Filed: July 21, 1976

[51] Int. Cl.[2] ..... F42B 7/10

[52] U.S. Cl. ..... 102/38; 102/92.4; 102/95; 244/3.23

[58] Field of Search ..... 244/3.23; 102/92.1–92.4, 95, 38

[56] References Cited

U.S. PATENT DOCUMENTS

| | | | |
|---|---|---|---|
| 3,062,145 | 11/1962 | Morgan et al. | 102/92.1 |
| 3,200,751 | 8/1965 | Vitt | 102/92.4 |
| 3,394,905 | 7/1968 | Rapp | 244/3.23 |
| 3,566,793 | 3/1971 | Kruzell | 102/92.3 |
| 3,713,388 | 1/1973 | Pontoriero | 102/92.4 |

FOREIGN PATENT DOCUMENTS

| | | | |
|---|---|---|---|
| 111,895 | 8/1964 | Czechoslovakia | 102/92.1 |
| 1,257,337 | 2/1961 | France | 102/95 |
| 976,484 | 11/1964 | United Kingdom | 102/92.1 |

*Primary Examiner*—Charles T. Jordan
*Attorney, Agent, or Firm*—Eugene D. Farley

[57] ABSTRACT

A spinning shot gun projectile comprises a cylindrical body having radially projecting vanes arranged with respect to the longitudinal axis of the body at an angle predetermined for air impingement during the flight of the projectile, thereby imparting a spinning motion to the same and insuring an accurate trajectory. The rearward portion of the projectile body has an axial bore dimensioned to receive in bearing engagement the ram portion of wad means located forwardly of the powder. The thrust of the explosion thus is transmitted to the projectile centrally and forwardly of the same by the action of the ram, thereby further insuring true flight of the projectile.

4 Claims, 2 Drawing Figures

SPINNING SHOT GUN PROJECTILE

BACKGROUND AND SUMMARY OF THE INVENTION

This invention pertains to spinning shot gun projectiles. It pertains particularly to bullets for use in shot gun shells which spin as they travel through the air, thereby insuring their flight in a straight and true trajectory.

As is well known, rifles are provided with spiral grooves on the interior of the gun barrel. This rifling imparts to the rifle bullet a rotational motion or spinning which causes it to travel on a true course.

However, in the case of shot guns which are intended to fire shot in a characteristic pattern, the interior of the gun barrel is smooth and devoid of rifling. As a result, if for special purposes it is desired to fire a bullet or slug from the shot gun, the projectile tends to wobble and turn end over end during its flight. Consequently, it does not travel in a true course.

Attempts heretofore have been made to overcome this problem. Thus in U.S. Pats. Nos. 3,063,376, 3,394,905 and 3,398,682, shot gun bullets or slugs are described which spin when they are fired. However, the spinning motion is caused by the passage of the gases resulting from combustion of the powder through ports, or against interior vanes, associated with the bullet. The effect of the combustion gases is momentary and transitory, occuring only during the initial impulse applied to the bullet when the gun is fired. As a consequence, erratic motion of the bullet during its flight still occurs.

Still another problem resides in the fact that current rifled shot gun slugs are made of solid lead. As they pass from the muzzle of the gun barrel they collapse. This may distort them so that they travel in inaccurate paths. Also, since different shot gun barrels have different sized (choked) muzzle diameters, the current types of slugs will fit tightly in some and loosely in others.

It is the general purpose of the present invention to provide a shot gun projectile or slug which is caused by air impingement to spin during its entire projectory, thereby achieving the effect of gun barrel rifling without such rifling being present, and insuring that the projectile will travel straight and true to the target.

Another important object of the present invention is the provision of a shot gun projectile assembly including a projectile and associated wad means which transmits the propellant force to the projectile centrally and forwardly thereof, thereby further insuring that the projectile will travel without wobble and without turning end over end.

Other objects of the present invention include the provision of a spinning shot gun projectile which with a given charge of propellant travels more accurately, with greater velocity, and has greater penetration; which spins during its entire flight; which separates rapidly and cleanly from the wad means as soon as it leaves the gun barrel; which fits all sizes of choked gun barrels; which will not collapse permanently on leaving the gun muzzle; which is safe in use; and which can be manufactured at relatively low cost.

DESCRIPTION OF PREFERRED EMBODIMENTS OF THE INVENTION

Figure 1:
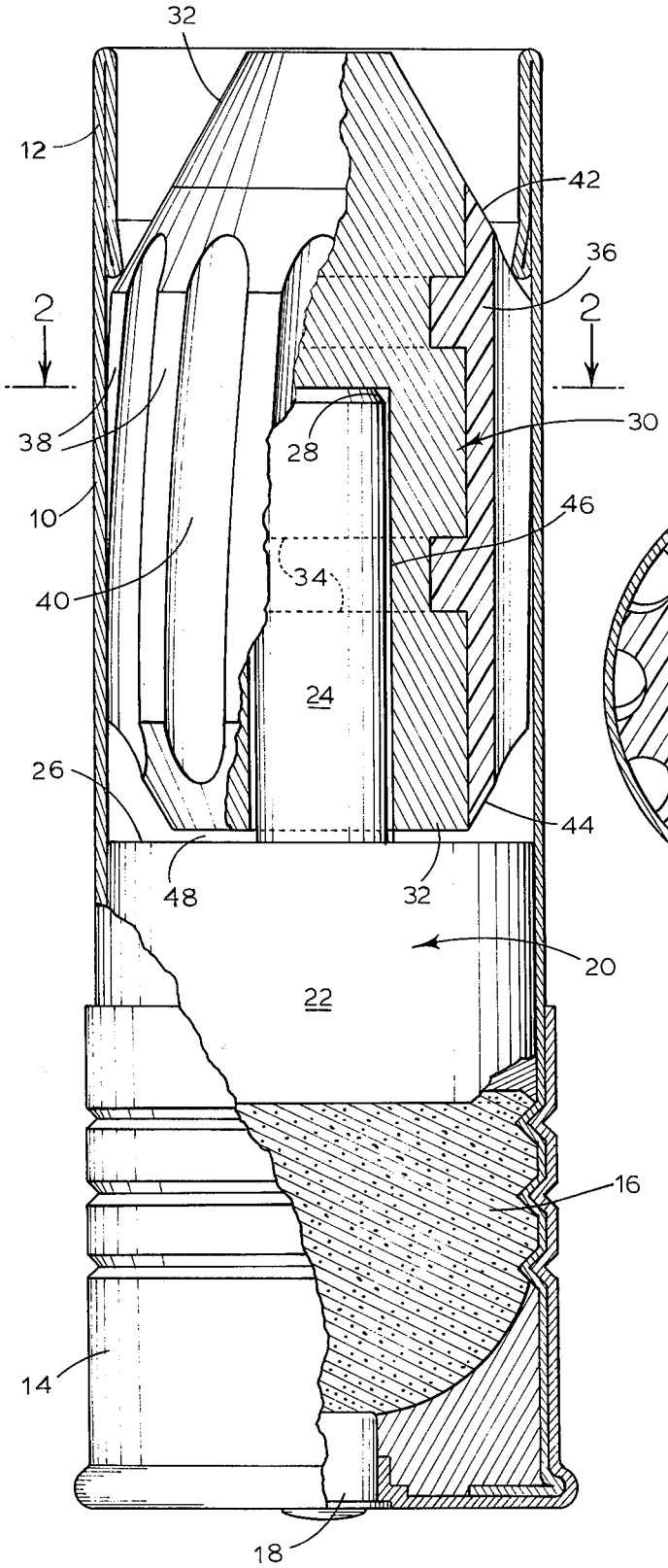
Figure 2:
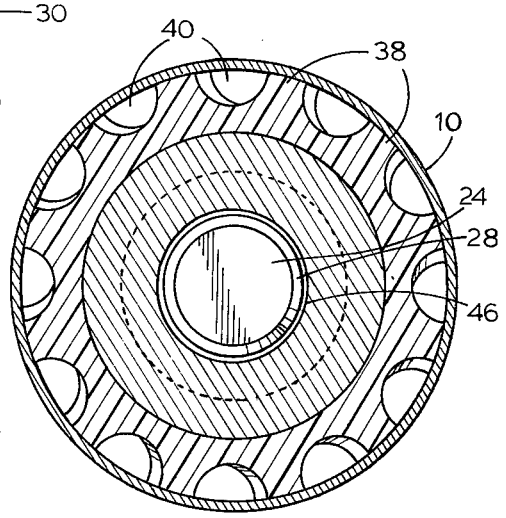

The manner in which the foregoing and other objects of the invention are accomplished will be apparent from the accompanying specification and claims, considered together with the drawings wherein:

FIG. 1 is a view in elevation, partly in longitudinal section, of a shot gun shell including the hereindescribed spinning projectile and FIG. 2 is a transverse sectional view taken along line 2—2 of FIG. 1.

As shown particularly in FIG. 1, the shot gun shell assembly includes a conventional hollow cylindrical case 10 made in the usual manner from waterproof cardboard and provided with a reverse fold 12 at its open forward end. The case is closed at its rearward end with the conventional metal cap 14 which contains a quantity of powder 16 fired by means of primer 18.

Powder 16 is retained by means of a novel wad means indicated generally at 20.

The wad means includes a cylindrical body portion 22 and an integral, central, forwardly extending ram 24. It may be made of a suitable plastic such as polyethylene or Teflon.

The body portion 22 of the wad means is cylindrical and fits snugly within cardboard case 10. Its leading surface provides a shoulder or impingement surface 26.

Ram extension 24 is of substantial length and is located centrally, or coaxially with the body portion. It is provided with a tapered forward end 28.

Cooperating with wad means 20 is the projectile or bullet indicated generally at 30.

Projectile 30 has a cylindrical body of substantial length made of lead, iron, or other heavy metal. The forward end 32 of the body is tapered for streamlining and decreased air resistance.

Projectile body 30 is provided with a plurality of spaced annular grooves 34 which seat a sleeve 36 made of durable plastic such as polyethylene or Teflon. The sleeve is molded about projectile body 32 with inward annular extensions seated in grooves 34 which accordingly key the sleeve to the body.

Sleeve 36 is formed with a plurality of spaced, substantially parallel, outwardly directed, radially extending vanes 38 arranged with respect to the longitudinal axis of the projectile body at an angle predetermined for air impingement during the flight of the projectile, thereby imparting a spinning motion to the projectile. The angle of the vanes preferably is from 0.5° to 3° with reference to the longitudinal axis of the projectile body. As seen in FIG. 2, the vanes are separated and defined by a plurality of longitudinal grooves or recesses 40.

The forward portion of sleeve 36, and of vanes 38 are forwardly tapered at 42 for sealing engagement with reverse fold 12 of case 10.

The rearward end of the sleeve and the vanes is rearwardly tapered at 44 for additional stream lining and decreased resistance to the air during flight of the projectile.

It is to be noted further that taper 44 of the sleeve exposes impingement surface 26 of the wad body 22. As a consequence, when the shell is fired, the impingement of air on impingement surface 26 creates a drag which pulls the wad free of the projectile, separating it immediately after it has left the gun barrel.

The projectile body 30 is further formed with an axial bore 46, FIG. 1. This is dimensioned to receive ram extension 24 of wad 20, but is somewhat shorter than the ram extension is long. This leaves a space 48 between the wad body and the trailing surface of the projectile.

This space serves an important function. It insures that the thrust exerted by the propellant will be transmitted primarily to the forward central portion of the projectile through the action of ram 24. As a consequence, any tendency of the projectile to cock and spin end over end as it leaves the shot gun barrel is overcome.

The mode of operation of the hereindescribed shot gun projectile is evident from the above.

When the shell is fired, wad 20 and projectile 30 are ejected from the barrel of the shot gun. The thrust of the explosion is transmitted through body 22 of wad 20 to ram extension 24 thereof. It then is transmitted selectively through the ram to the forward central portion of the projectile 30, preventing it from turning end over end.

As soon as the projectile and wad leave the gun barrel, impingement of air on surface 26 of wad body 22 causes prompt and clean separation of the projectile from the wad body. As the projectile continues on its flight, pressure of air on spiraled vanes 38 causes the projectile to spin in a direction determined by the direction of angle of the vanes. This effect continues during the entire trajectory of the projectile, causing it to spin uniformly and thus follow a straight and true path during its entire flight.

Also since the outside surface of my spinning shot gun projectile is made of a resiliently deformable substance such as polyethylene or Teflon, upon firing it will momentarily collapse and conform to the choked area of the muzzle of the gun barrel without permanent distortion. This allows a tighter fit in the gun barrel and insures that the projectile will remain round after firing. Both of these factors improve the flight accuracy of the projectile.

Having thus described my invention in preferred embodiments, I claim:

1. For use in a shot gun shell comprising a hollow cylindrical case open at its forward end and closed at its rearward end, a propellant in the rearward portion of the case, and a primer mounted in the closed rearward end of the case, a projectile assembly comprising:

a. wad means in the case forwardly of the propellant for retaining the latter in the case, the wad means including a rearward cylindrical body portion arranged to fit snugly within the case for retaining the propellant therein and an integral forward ram portion coaxial with but of smaller diameter than the body portion and extending forwardly therefrom, b. a cylindrical projectile body dimensioned for insertion in the case forwardly of the body portion of the wad means, the projectile body having an axial bore extending forwardly from its rearward end and dimensioned to received the ram portion of the wad means freely therein, the bore having a length slightly less than the length of the ram portion of the wad means whereby to space the rearward end of the projectile body slightly forward of the forward end of the body portion of the wad means and to abut the forward end of the ram portion of the wad means against the inner end of the bore, and c. a plurality of circumferentially spaced, radially extending spinner vanes on the exterior surface of the projectile body arranged with respect to the longitudinal axis of the projectile body at an angle predetermined to impart a spinning motion to the projectile body during its flight by impingement of air on said vanes.

2. The projectile assembly of claim 1 wherein a rearward end portion of the projectile body is of reduced diameter to expose a forward transverse surface of the body portion of the wad means to the impingement of air during flight, whereby to effect separation of the wad means from the projectile body after it has left a gun barrel.

3. The projectile assembly of claim 1 wherein the projectile body has a forward nose portion of progressively decreasing diameter, and the vanes extend substantially the full length of the projectile body rearwardly from adjacent the rearward end of the nose portion.

4. The projectile assembly of claim 1 wherein the projectile body includes a heavy metal core provided with at least one annular groove intermediate the ends of its outer surface, and a plastic sleeve overlying the core and including an annular extension on its inner surface seated in the annular groove for securing the sleeve to the core, the vanes being integral with the sleeve.

* * * * *